United States Patent [19]

Felicetti

[11] 4,316,564

[45] Feb. 23, 1982

[54] DISPENSER FOR TINFOIL AND THE LIKE

[75] Inventor: Luigi Felicetti, Milan, Italy

[73] Assignee: Euram Italia S.p.A., Milan, Italy

[21] Appl. No.: 171,105

[22] Filed: Jul. 22, 1980

[30] Foreign Application Priority Data

Jul. 27, 1979 [IT] Italy ..... 22221/79[U]

[51] Int. Cl.[3] ..... B26D 1/02

[52] U.S. Cl. ..... 225/77; 83/648; 242/73

[58] Field of Search ..... 225/77, 47, 45, 44, 225/66; 83/648, 649; 242/73

[56] References Cited

U.S. PATENT DOCUMENTS

| | | | |
|---|---|---|---|
| 2,730,310 | 1/1956 | Schultz | 225/77 X |
| 2,759,545 | 8/1956 | Rizza | 225/45 X |
| 3,249,273 | 5/1966 | Robinson | 225/77 X |
| 4,037,769 | 7/1977 | Meyers | 242/73 X |

*Primary Examiner*—Frank T. Yost
*Attorney, Agent, or Firm*—Karl F. Ross

[57] ABSTRACT

A dispenser for tinfoil and other sheet materials, wound on a roll, comprises a cylindrical roll-supporting mandrel fixedly secured to one of two flat cheeks and provided at its free end with a threaded extension of reduced diameter passing through a hole in the other cheek. The other cheek is held by a milled knob, threaded onto the outwardly projecting end of the mandrel extension, in contact with a tubular spacer of the same diameter as the mandrel, traversed by that extension, or with a disk-shaped counternut threaded onto that extension between the two cheeks whereby the effective length of the mandrel is adjustable to accommodate rolls of different sizes. A serrated blade paralleling the mandrel has one end fixed to the first sheet and traverses with its opposite end a slot in the other cheek.

8 Claims, 5 Drawing Figures

Fig. 1
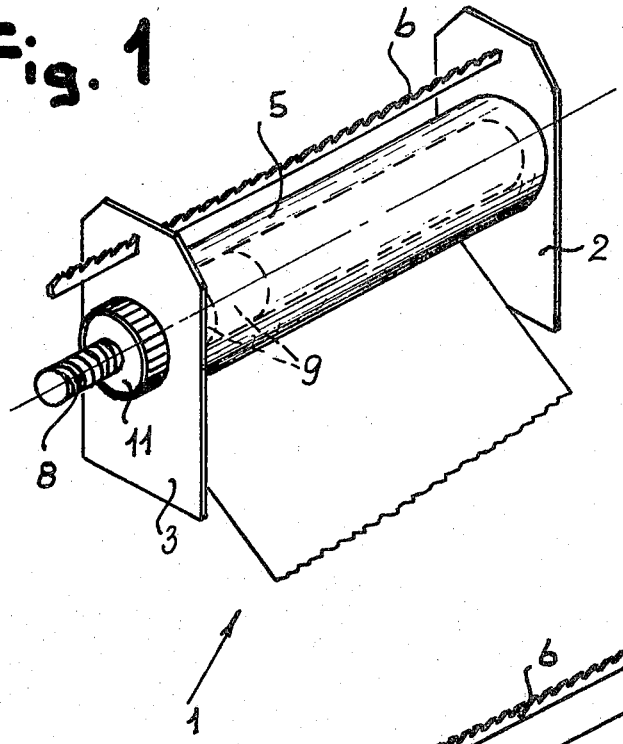
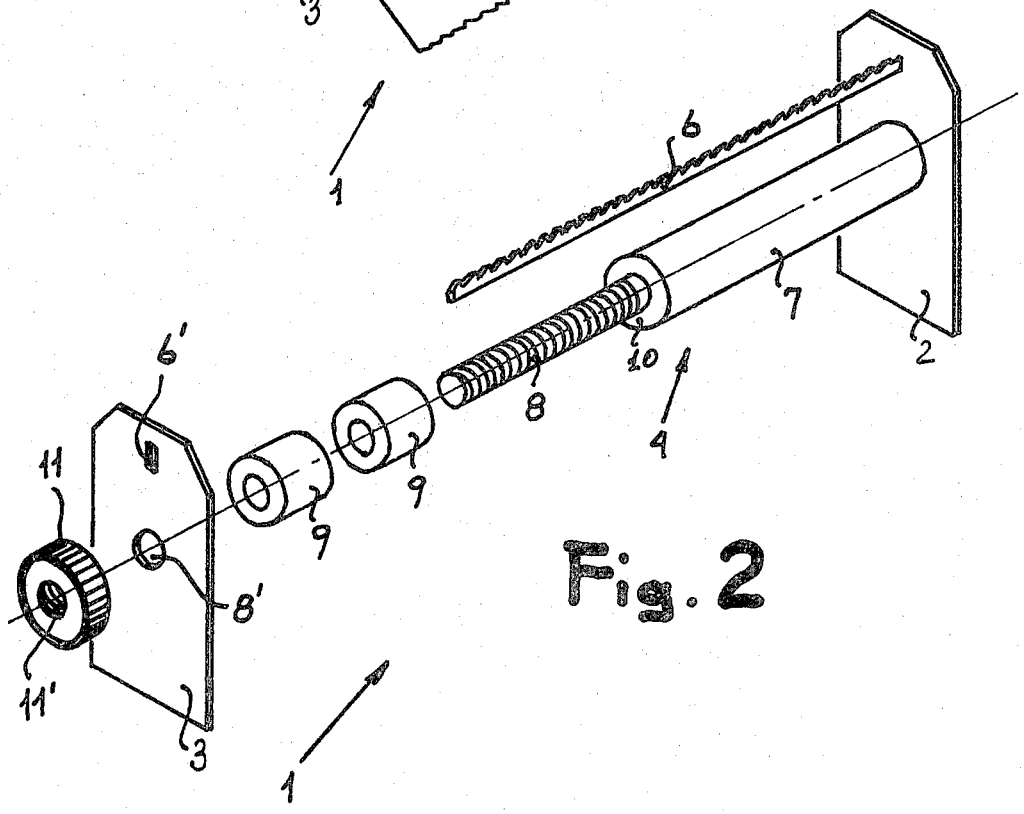
Fig. 2

DISPENSER FOR TINFOIL AND THE LIKE

FIELD OF THE INVENTION

My present invention relates to a dispenser for sheet material, such as tinfoil, available in the form of rolls from which sections of variable length may be severed.

BACKGROUND OF THE INVENTION

Such dispensers generally comprise a mandrel which is removably mounted between two relatively fixed cheeks to support a roll of sheet material (referred to hereinafter, for convenience, as tinfoil) as well as a serrated blade parallel to the mandrel enabling a section of tinfoil to be cut off. The maximum length of the tinfoil roll is determined by the length of the mandrel and the spacing of the cheeks.

In order to allow the use of rolls of different lengths, not exceeding that maximum, it has already been proposed to provide the mandrel with an adjustable collar which can be axially shifted thereon and has an outer diameter exceeding the inner diameter of the tinfoil roll, thereby serving as a stop for the latter. If that collar is held against rotation in a selected axial position, it may exert an undesirable braking effect upon the roll inasmuch as its convolutions of larger diameter will tend to shift sideways so as to envelop that collar.

OBJECTS OF THE INVENTION

An object of my present invention is to provide an improved dispenser for tinfoil and the like which is readily adjustable to accommodate rolls of different lengths while avoiding the inconvenience referred to above.

A more particular object of my invention is to provide a dispenser which can be stood on its end on a table or other supporting surface so as to enable its use in a horizontally limited space.

SUMMARY OF THE INVENTION

A dispenser according to my present invention comprises a roll-supporting cylindrical mandrel which has a first extremity secured to a first cheek and a second extremity passing through a hole in a second cheek, a serrated blade parallel to the mandrel having one end fixed to the first cheek and another end traversing a slot in the second cheek, and fastening means engaging the second extremity and the second cheek for removably holding same at a distance from the first cheek selected according to the length of a roll to be accommodated.

Pursuant to a more particular feature of my invention, the second extremity of the mandrel is a threaded extension of reduced thickness. A part of that extension, projecting beyond the second cheek, is threadedly engaged by a knob forming part of the aforementioned fastening means, the latter further including an adjustable counterbearing on that extension inserted between the second cheek and an annular face of the mandrel at its junction with the threaded extension. The counterbearing may be formed by one or more tubular spacers, of the same diameter as the mandrel, resting against that annular face; alternatively, it may be constituted by a nut threaded onto the extension at a selected location remote from the mandrel face.

BRIEF DESCRIPTION OF THE DRAWING

The above and other features of my invention will now be described in detail with reference to the accompanying drawing in which:

FIG. 1 is a perspective view of a dispenser according to my invention, loaded with a tinfoil roll;

FIG. 2 is an exploded perspective view of the dispenser of FIG. 1, shown without the roll;

SPECIFIC DESCRIPTION

Figure 3:
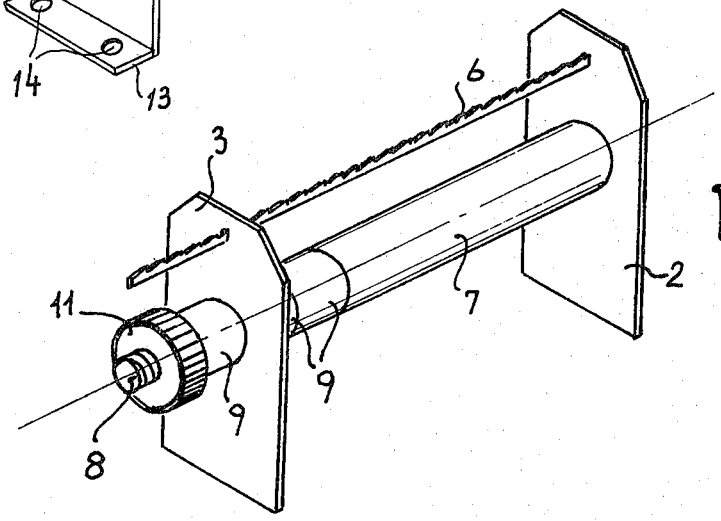
FIG. 3 is a view similar to FIG. 1 but with the roll again omitted.

A tinfoil dispenser 1 shown in FIGS. 1–3 comprises two cheeks 2, 3 in the form of parallel plates of rectangular outline with two beveled corners. The first cheek 2 is fixedly secured to a supporting member 4 for a tinfoil roll 5, member 4 comprising a cylindrical mandrel 7 with a threaded extension 8 which is also cylindrical but of reduced diameter. A serrated blade 6, parallel to member 4, is fastened at one end to cheek 2. The other cheek 3 has a hole 8', slightly larger in diameter than mandrel extension 8, and a slot 6' slidably accommodating the free end of blade 6.

When the dispenser is to be used with a very short tinfoil roll, the mobile cheek 3 is brought into direct contact with an annular face 10 of mandrel 7 whose extension 8 traverses the hole 8' and is engaged outside cheek 3 by a milled knob 11 provided with a threaded bore 11'. With rolls of greater length, however, one or more tubular spacers 9 of the same outer diameter as mandrel 7 are inserted between face 10 and cheek 3, as shown in FIGS. 1–3, to form a practically continuous cylindrical supporting surface between the two cheeks. If desired, one or more further spacers may also be traversed by the projecting part of extension 8 between cheek 3 and knob 11, as illustrated in FIG. 3, to serve as a handgrip for the dispenser.

Figure 4:
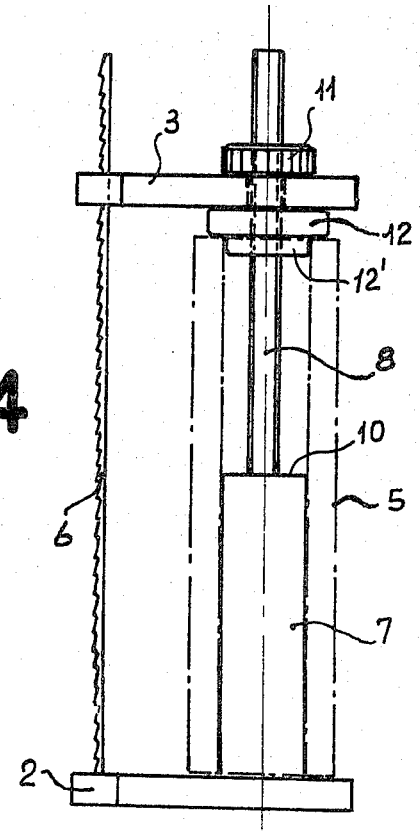
FIG. 4 is a side-elevational view of a modified dispenser according to my invention, stood on its end.

Since the fixed cheek 2 has a flat outer surface without external obstructions, the dispenser may be vertically positioned with that surface resting on a tabletop or the like as illustrated in FIG. 4. The latter Figure also shows a modification of the aforedescribed embodiment in which the spacers 9 have been replaced by a nut 12 in the form of a stepped disk threaded onto mandrel extension 8 at a location spaced from face 10 by a distance depending on the length of roll 5; the stepped-down portion 12' of nut 12 has a diameter equal to that of mandrel 7 so as to fit into the adjacent end of the roll. If desired, the clearance between nut 12 and face 10 could be occupied by one or more spacers of the type shown at 9 in FIGS. 1–3; again, such a spacer (or several of them) could be inserted on the free end of mandrel extension 8 between cheek 3 and knob 11.

Figure 5:
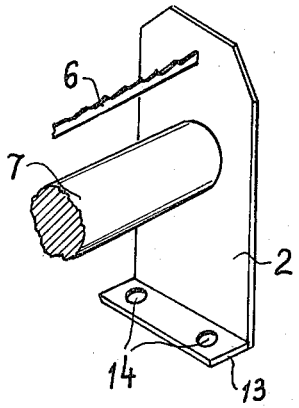
FIG. 5 is a perspective view of a modified cheek for a dispenser according to FIGS. 1–4.

FIG. 5 illustrates the possibility of providing cheek 2 with a formation facilitating the attachment of the dispenser to either a horizontal shelf or a vertical wall, namely a flange 13 having mounting holes 14. The mobile cheek 3, and possibly cheek 2 as well, could be fitted with an adhesive-coated lug or a suction cup enabling its temporary immobilization on a supporting surface.

When the roll of tinfoil is rotatably wound on a sufficiently rigid tubular core fitting around the mandrel 7, that core could itself act as a counterbearing for the knob 11, thus eliminating the need for spacers 9 and nut 12.

I claim:

1. A dispenser for sheet material wound on a roll, comprising:

a first and a second cheek;

a roll-supporting cylindrical mandrel having a first extremity secured to said first cheek and a second extremity passing through a hole in said second cheek;

a serrated blade parallel to said mandrel having one end fixed to said first cheek and another end traversing a slot in said second cheek; and fastening means engaging said second extremity and said second cheek for removably holding same at a selected distance from said first cheek, thereby accommodating rolls of different lengths.

2. A dispenser as defined in claim 1 wherein said second extremity is a threaded extension of reduced thickness, said fastening means comprising a knob threadedly engaging a part of said extension projecting beyond said cheek and an adjustable counterbearing on said extension inserted between said second cheek and an annular face of said mandrel at its junction with said extension.

3. A dispenser as defined in claim 2 wherein said counterbearing comprises at least one tubular spacer, of the same diameter as said mandrel, resting against said annular face.

4. A dispenser as defined in claim 2 wherein said counterbearing comprises a nut threaded onto said extension at a location remote from said annular face.

5. A dispenser as defined in claim 4 wherein said nut is stepped with a reduced portion of the same diameter as said mandrel confronting said annular face.

6. A dispenser as defined in claim 2, further comprising a tubular spacer interposed on said extension between said knob and said second cheek.

7. A dispenser as defined in claim 1 or 2 wherein said first cheek has a flat outer surface enabling a positioning thereof on a supporting surface with said mandrel and said blade vertical.

8. A dispenser as defined in claim 1 or 2 wherein said cheeks are provided with formations facilitating an attachment thereof to a support surface.

* * * * *